US006537089B1

(12) United States Patent
Montague

(10) Patent No.: US 6,537,089 B1
(45) Date of Patent: Mar. 25, 2003

(54) GATED ELECTRICAL SAFETY OUTLET

(75) Inventor: William A. Montague, Concord, MA (US)

(73) Assignee: Safer Home, Inc., Concord, MA (US)

( * ) Notice: Subject to any disclaimer, the term of this patent is extended or adjusted under 35 U.S.C. 154(b) by 0 days.

(21) Appl. No.: 10/017,401

(22) Filed: Dec. 14, 2001

(51) Int. Cl.[7] ..... H01R 13/44
(52) U.S. Cl. ..... 439/145; 439/137
(58) Field of Search ..... 439/145, 143, 439/137–142, 144; 174/67

(56) References Cited

U.S. PATENT DOCUMENTS

| | | | | | |
|---|---|---|---|---|---|
| 4,040,698 | A | | 8/1977 | Oritz | 439/136 |
| 4,722,693 | A | * | 2/1988 | Rose | 439/137 |
| 4,867,694 | A | * | 9/1989 | Short | 439/137 |
| 5,069,630 | A | * | 12/1991 | Tseng et al. | 439/137 |
| 6,217,353 | B1 | * | 4/2001 | Yu-Tse | 439/145 |

OTHER PUBLICATIONS

Print–out from Smart Source Product Center website at www.smartsourceproducts.com, printed on Mar. 28, 2002.

* cited by examiner

*Primary Examiner*—P. Austin Bradley
*Assistant Examiner*—Ross Gushi
(74) *Attorney, Agent, or Firm*—Francis J. Caufield

(57) ABSTRACT

An electrical outlet, used with a plug having live and neutral prongs of equal length, comprises support member having live and neutral apertures, and live and neutral receptacles for receiving the prongs. A blocking member lies between the support member and the receptacles, and moves between a closed position, in which it blocks the apertures, and an open position, it which it does not block these apertures, thus permitting the prongs to enter the receptacles. The blocking member is biased towards its closed position, but has a cam surface which contacts the entering neutral prong and moves the blocking member to its open position. The blocking member also has a recess so that, when the blocking member is in its closed position, a portion of the live prong can lie within the recess.

14 Claims, 6 Drawing Sheets

(A)

(B)

GATED ELECTRICAL SAFETY OUTLET

FIELD OF THE INVENTION

This invention in general relates to electrical safety devices and in particular to a gated electrical safety outlet, i.e., an electrical outlet in which a "gate" or "blocking member" is provided to ensure that a person cannot receive an electrical shock by inserting an object into the outlet and contacting its live internal receptacle.

BACKGROUND OF THE INVENTION AND PRIOR ART

It has long been recognized that conventional electrical outlets pose a safety hazard because it is possible for a person to insert a narrow electrical conductor, such as a paper clip or screwdriver, through the "live" aperture intended to accommodate the live prong of an electrical plug and thus contact the live internal receptacle lying behind this aperture to cause an electrical shock that is potentially fatal. Although young children are especially exposed to this hazard, it not unknown for adults working near an electrical outlet to let a screwdriver or similar tool inadvertently enter the aperture to cause an electrical shock.

Several approaches have been taken to remove or reduce this serious safety hazard. In homes with young children, it is common practice to "childproof" electrical outlets which are not in use by inserting non-conducting plastic safety devices which have prongs arranged to be gripped by the receptacles of the outlet and a cover plate which completely covers all the apertures of the outlet. Although this approach is effective in principle, it suffers from several practical disadvantages. The safety devices must be removed before an outlet can be used and replaced immediately after use of the outlet is concluded. A busy, perhaps distracted, parent can easily forget to replace the safety device. In addition, such devices being small and light weight are easily lost; especially, for example, on a crowded kitchen work surface. Hence, once removed, such small devices, if left unattended on a counter or floor, can be picked up by small children and become a different kind of hazard if the child places it in his or her mouth. It is also not unknown for the prongs of such devices to break off after repeated use, thus rendering the outlet unusable until it is disassembled and the broken prong removed. A modern single family house may have more than 60 outlets (counting both parts of the conventional double outlet separately), and locating all the outlets and providing them with individual safety devices is no small task, especially since young children are adept at finding outlets in places (for example in narrow spaces below furniture) which are inaccessible to adults. Finally, and perhaps most importantly, even though families with young children will put up with all the aforementioned problems, it is unreasonable to expect similar tolerance in the homes of grandparents, aunts, uncles, other relatives or simply friends and neighbors, where young children are present only occasionally.

The aforementioned disadvantages of removable safety devices indicate a need for a form of safety device which is permanently installed within an electrical outlet so that it blocks attempts to introduce foreign objects into the live aperture of the outlet (thus preventing such foreign objects contacting the live receptacle and giving the person holding the object an electric shock) but permits an electrical plug to be inserted into the outlet in the normal manner. For example, electrical power strips are known which comprise a plug, an extension cable one end of which is connected to the plug, and an outlet block connected to the opposed end of the cable, one surface of this outlet block forming a face plate and bearing a plurality of electrical outlets. In some such power strips the outlets are equipped with blocking members or gates installed behind the face plates of the electrical outlets. Each blocking member is normally in a closed position in which its blocks its associated outlet but has a projection which extends through a side surface of the outlet block so that the blocking member can be moved manually sideways to an open position to open the outlet and permit a plug to be inserted therein in the normal manner. The blocking member is provided with biasing means so that when the plug is removed from the outlet, the blocking member moves back to its closed position.

Unfortunately, this type of blocking member or "gate" is not readily applicable to conventional wall mounted electrical outlets, where the face plate is essentially flush with the surrounding wall surface, since in such outlets it is not possible to provide manual access to the periphery of the blocking member, as required to allow manual movement of the blocking member to open the outlet. Furthermore, it is not practical to modify such a blocking member by providing a manually-movable extension which projects through the face plate. Such a modification would require a non-standard face plate and many people desire to use standard form but colored or otherwise decorated face plates to match room decor. More importantly, it is today common practice to insert into electrical outlets devices which lie flat against portions of the outlet extending well beyond the openings through which plugs are inserted into the outlets. Examples of such devices include power bricks (step-down transformers/rectifiers used to supply low voltage direct current to power portable computers and other consumer electronics) and surge suppressor adapters. Thus, any requirement to change the external form of an electrical outlet is likely to be unacceptable to many consumers.

In view of the foregoing, it is a primary object of the present invention to provide an electrical outlet which blocks attempts to introduce foreign objects into the outlet in a manner which risks giving the person holding the object an electric shock but which permits an electrical plug to be inserted into the outlet in the normal manner. In particular, it is an object of the present invention to provide such a protected electrical outlet which does not require removal of a member from the outlet before a plug can be inserted therein.

It is a further object of the present invention to provide such a protected electrical outlet which has the same external form as a conventional unprotected outlet, thus permitting the protected outlet to accommodate any electrical device which can be accommodated by the unprotected outlet.

It is an object of the present invention to provide a protected electrical outlet which does not require the use of special plugs.

It is also an object of the present invention to provide a gated electrical outlet which is resistant to being opened by an object inserted into its live aperture.

Other objects of the invention will be apparent and will appear hereinafter in the following detailed description when read in connection with the drawings.

SUMMARY OF THE INVENTION

This invention provides an electrical outlet adapted to receive an electrical plug having at least live and neutral prongs of equal length. The outlet comprises a support member having an outer surface, an inner surface and at least live and neutral apertures extending from the outer surface to the inner surface of the support member; a live receptacle adapted to receive the live prong and spaced from the inner surface of the support member adjacent the live aperture therein; and a neutral receptacle adapted to receive the neutral prong and spaced from the inner surface of the support member adjacent the live aperture therein. The support member and the live and neutral receptacles are arranged so that the live and neutral prongs of the electrical plug can be inserted through the live and neutral apertures, respectively, in the support member and enter the live and neutral receptacles, respectively. The outlet further comprises a blocking member disposed between the inner surface of the support member and the receptacles. The blocking member is movable between a closed position, in which it blocks the live and neutral apertures in the support member, and an open position, it which it does not block the live and neutral apertures, thereby permitting the live and neutral prongs of the electrical plug to pass through the live and neutral apertures, respectively, in the support member and enter the live and neutral receptacles, respectively. The blocking member has biasing means for biasing the blocking member towards its closed position; a cam surface disposed adjacent the neutral aperture and arranged to be engaged by the neutral prong passing through the neutral aperture so that contact between the neutral prong and the cam surface causes the blocking member to move to its open position. The blocking member also has a recess arranged so that, when the blocking member is in its closed position, the recess lies adjacent the live aperture such that a portion of the live prong can be accommodated within the recess while the blocking member is still in its closed position.

The terms "inner" and "outer" are used herein with reference to the direction of movement of a plug being pushed into the outlet. Thus, the outer surface of the support member is that which is visible when the outlet is installed, the prongs of the plug passing first through this surface of the support member. Terms such as "extending inwardly" etc. are to be construed in a similar manner.

BRIEF DESCRIPTION OF THE DRAWINGS

The structure and operation of the electrical outlet of the present invention, together with other objects and advantages thereof, may best be understood by reading the detailed description in connection with the drawings in which unique reference numerals have been used throughout for each part and wherein.

DETAILED DESCRIPTION OF THE INVENTION

Figure 1:
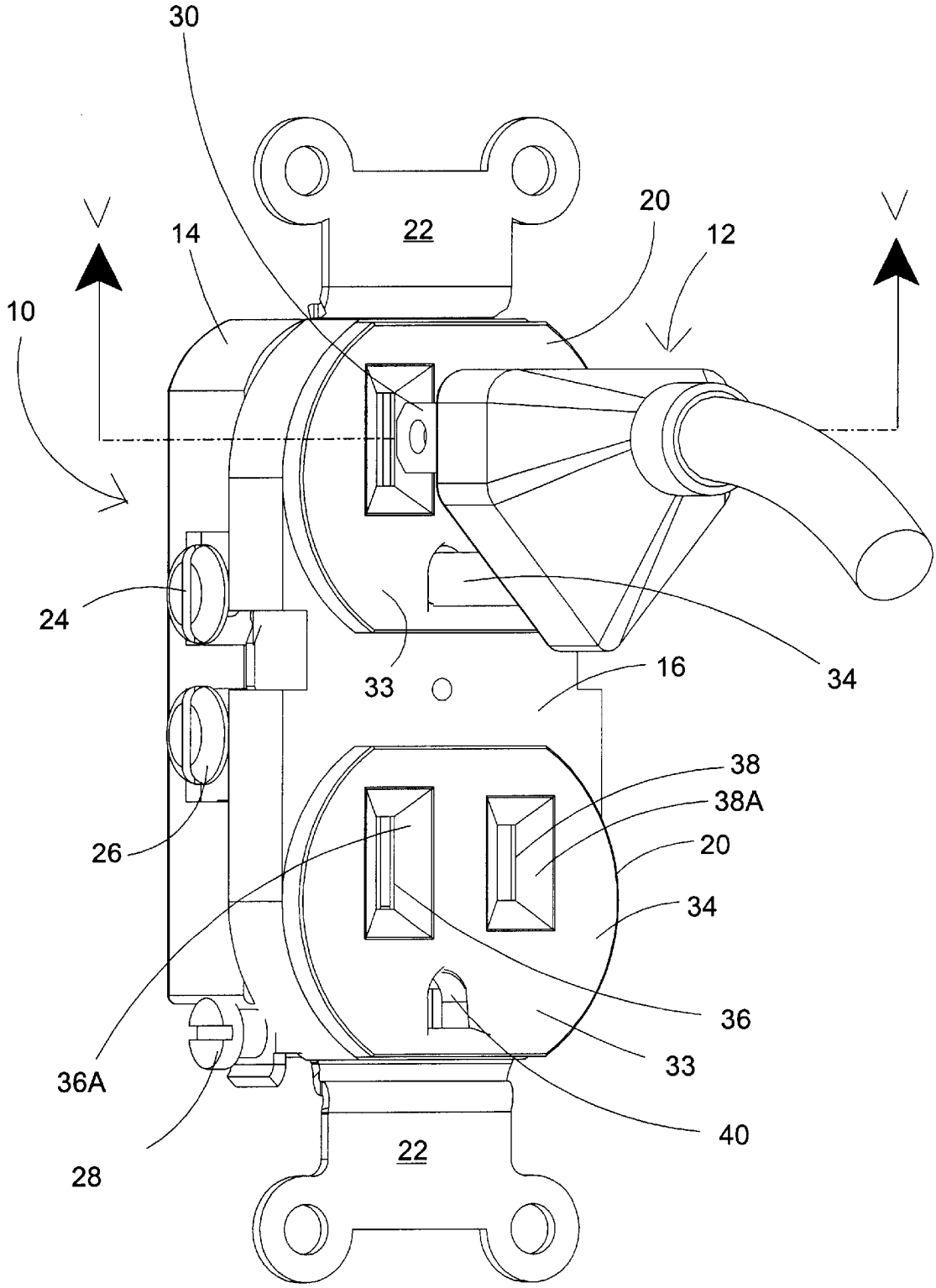
FIG. 1 is a diagrammatic three-quarter perspective view, from in front and to one side, of a double electrical outlet of the present invention arranged to receive two separate plugs, the outlet being shown with a three-pin plug being inserted into the outlet.
Figure 2:
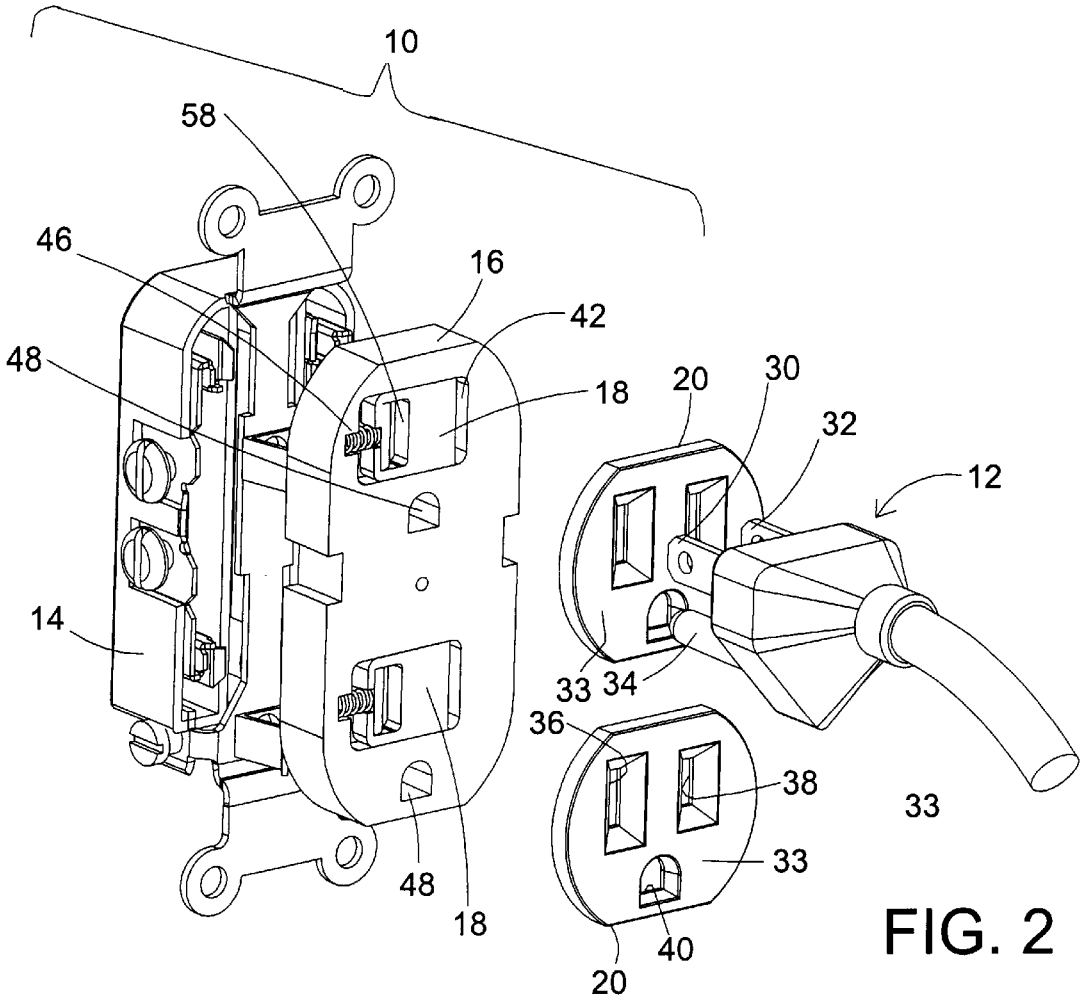
FIG. 2 is a diagrammatic exploded perspective view, on a smaller scale, of the various parts of the outlet shown in FIG. 1.

FIGS. 1 and 2 show a preferred double electrical outlet (generally designated 10) of the present invention with a three-pin plug (generally designated 12) being inserted therein. The outlet 10 comprises four main sections, namely:

(a) a base section 14 of conventional design and intended for mounting within a conventional outlet box (not shown);

(b) a support member 16 mounted on the base section 14 and accommodating two blocking members 18 (see FIG. 2) of the outlet; and (c) two separate face plates 20 mounted on the support member 16.

The base section 14 is provided with mounting lugs 22, line connectors 24 and 26, and a ground connector 28: Although not shown in FIGS. 1 and 2, the base section 14 also accommodates neutral, live and ground receptacles of conventional design arranged to receive respectively the neutral prong 30, the live prong 32 (FIG. 2) and the ground prong 34 of the plug 12.

Each of the face plates 20 is of substantially conventional design having a prismatic form with an outer surface 33, a corresponding inner surface (not shown in FIGS. 1 and 2) and a neutral aperture 36, a live aperture 38 and a ground aperture 40, each extending from the outer surface to the inner surface of the face plate 20 and sized and spaced apart so that the corresponding neutral, live and ground prongs 30, 32 and 34, respectively, of the plug 12 can pass through these apertures. As in a conventional, non-gated outlet, the neutral and live apertures 36 and 38 are rectangular, with the neutral aperture 36 being larger in order to accommodate the larger neutral prong of a polarized plug (cf. FIG. 3). Both apertures 36 and 38 are provided with inclined surfaces 36A and 38A, respectively, to guide the prongs into the apertures 36 and 38. The ground aperture 40 has the conventional, approximately semi-circular, cross-section. In the outlet as sold to a customer, the face plates 20 are welded or otherwise secured to the support member 16.

Although, as already indicated, the base section 14 and the face plates 20 are of substantially conventional form, the support member 16 is not, since it is required to accommodate the novel blocking member 18 of the present invention. Accordingly, the support member 16 and the associated parts of the outlet 10 will now be described in more detail with reference to FIGS. 2, 4, and 5.

Figure 5:
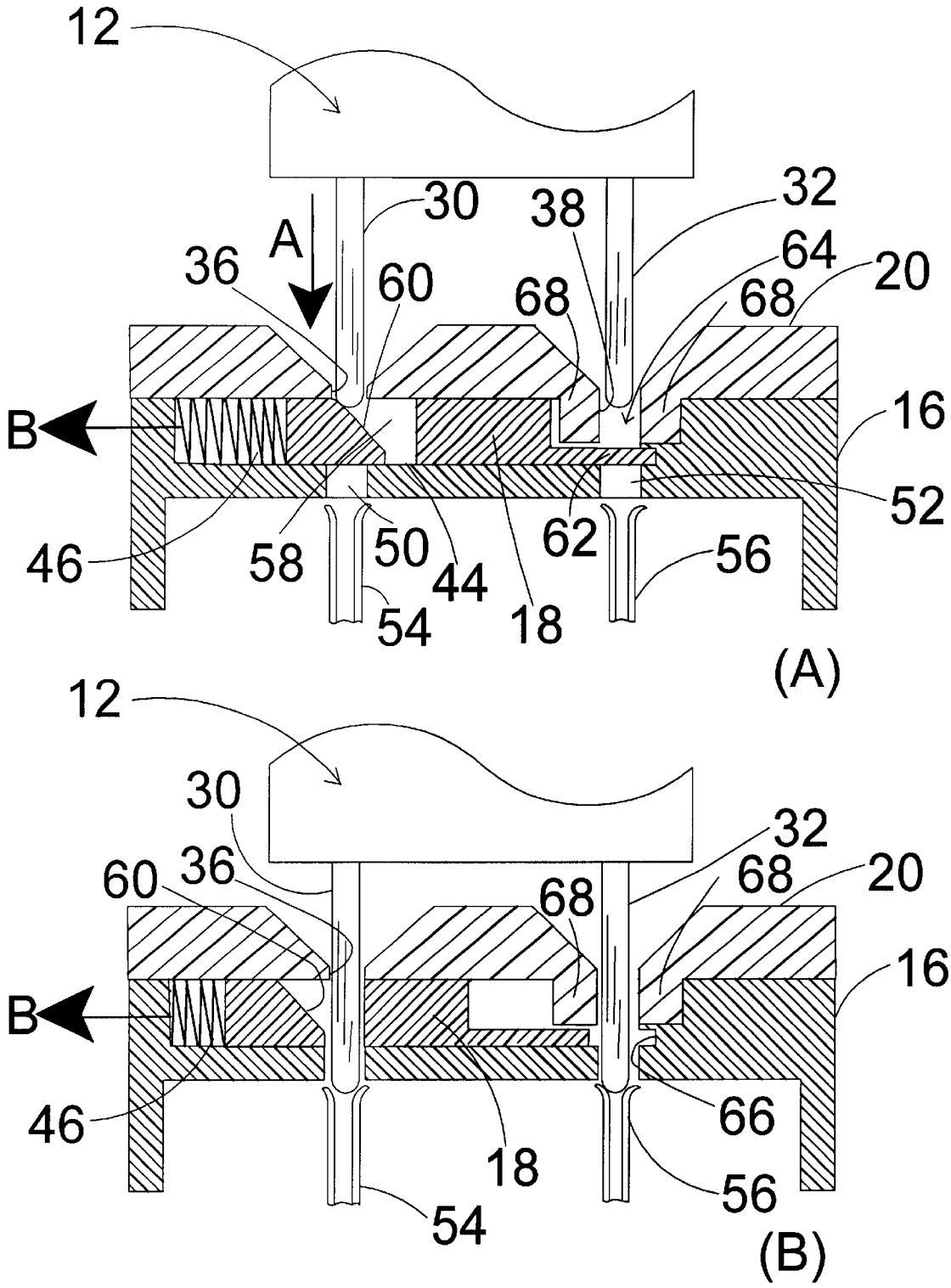
FIGS. 5A and 5B are diagrammatic section views, taken along line V—V in FIG. 1, illustrating the closed and open positions, respectively, of the blocking member of the outlet shown in FIGS. 1, 2 and 4.

As best seen in FIG. 2, the support member 16 has a flat, prismatic form comprising essentially identical upper and lower halves, each half carrying one face plate 20. Accordingly, only the upper half of the support member 16 will be described in detail. This upper half is provided with a substantially rectangular recess 42, which accommodates but is substantially longer than, the blocking member 18, so that the blocking member 18 can slide longitudinally along the recess 42. As shown in FIG. 5, the recess 42 does not extend completely through the support member 16; the support member 16 has a flat support surface 44 (FIG. 5) which lies parallel to the inner surface of the face plate 20 so that when the face plate 20 is fixed to the support member 16, a chamber 42 is created between the support surface 44 and the face plate 20. This chamber accommodates the blocking member 18 and limits the movement thereof. The blocking member 18 is movable between a closed position, shown in FIGS. 2 and 5A, in which the blocking member is spring biased (spring 46) to the right (in those Figs.), and an open position, shown in FIG. 5B, in which the blocking member has been pushed to the left. A helical spring 46 acts between one end wall of the blocking member 18 and one end wall of the recess 42 to bias the blocking member 18 towards its closed position.

In addition to the recess 42, each half of the support member 16 is provided with a ground aperture 48, which is of the same form as, and aligned with, the ground aperture 40 in the face plate 20, so that the ground prong 34 of the plug 12 can pass unhindered through apertures 40 and 48 as the plug 12 is inserted into the outlet 10. Note that, since the ground aperture 48 is spaced from the recess 42, when the blocking member 18 is in its closed position, it does not block the ground apertures 40 and 48. This enables a smaller, lighter blocking member to be used, but does not compromise the safety of the outlet, since there is no danger to a user from inserting an object through the apertures 40 and 48 into the ground receptacle of the outlet.

Each half of the support member 16 is also provided with a neutral aperture 50 (FIG. 5) and a live aperture 52; these apertures extending from the support surface 44 to the inner surface of the support member 16 and being aligned with the neutral and live apertures 36 and 38, respectively, in the face plate 20. The live and neutral apertures 50 and 52 are also aligned with the previously mentioned live and neutral receptacles 54 and 56, respectively.

Figure 4:
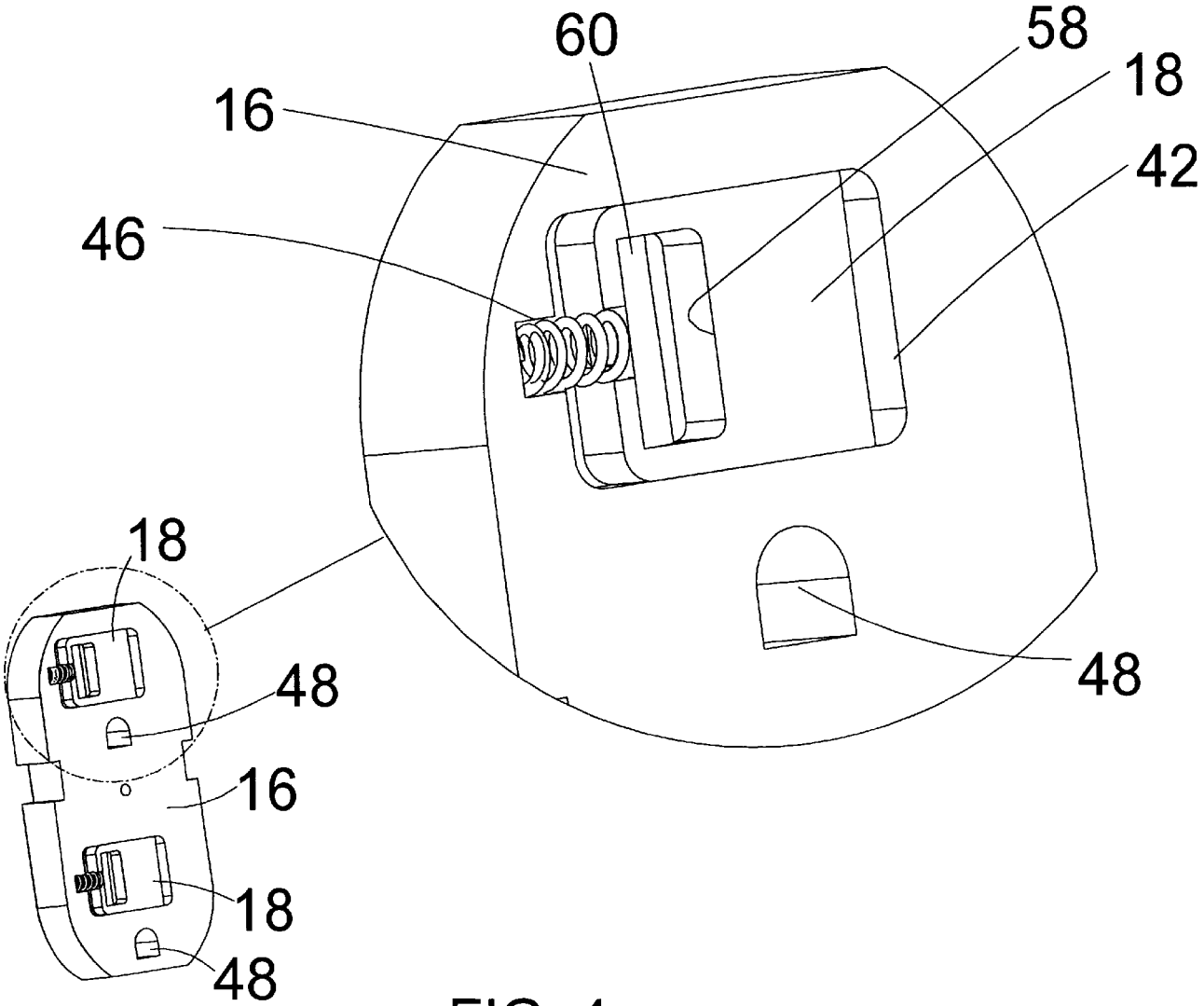
FIG. 4 is an enlarged diagrammatic three-quarter perspective view of part of the support member shown in FIG. 2 and illustrates the biasing means of the outlet.

The form of the blocking member 18 and the manner in which it cooperates with the plug 12 to secure safe use of the outlet 10 will now be described in detail with reference to FIGS. 4, 5A, and 5B. As already mentioned, FIG. 5A shows the blocking member 18 in its closed position. As best seen in FIG. 4, blocking member 18 has substantially the form of a flat, rectangular plate through the end of which, adjacent the spring 46, passes a neutral aperture 58 large enough to enable the neutral prong 30 of the plug 12 to pass therethrough. Part of the wall of the neutral aperture 58 is inclined at approximately 45° to the thickness of the blocking member 18 to form a cam surface 60. The end of the blocking member 18 remote from the spring 46 has a section 62 of reduced it thickness, thus leaving a recess 64 between this section 62 and the inner wall of the face plate 20, this recess 64 extending to the free edge of the blocking member 18. A recess 66 is formed in the support member 16 adjacent the free edge of the blocking member 18, and a projections 68 is provided on the inner surface of the face plate 20 adjacent the live aperture 38 therein, this projection 68 extending into the recess 64. Cam surface may also be formed with suitable shapes other than as a 45° inclined plane and still effectively function.

As shown in FIG. 5A, the placement of the neutral aperture 58 and the section 62 of the blocking member 18 is such that, when the blocking member 18 is in its closed position, the neutral aperture 58 is displaced to the right (in FIG. 5A) relative to the neutral aperture 36 in the face plate 20. In this position, the blocking member 18 blocks the neutral aperture 36, with only the outer portion of the cam surface 60 lying adjacent the neutral aperture 36. Also in this position, the section 62 of the blocking member 18 blocks the live aperture 38 in the face plate 20, with the free edge of the section 62 being received within the recess 66 in the support member 16. Thus, in its closed position, the blocking member 18 blocks both the neutral and live apertures in the face plate 20. Furthermore, the interactions between the blocking member 18 on the one hand, and the recess 66 and projection 68 on the other, render it very difficult, if not impossible, to insert an object into the live aperture 38 in the face plate 20 and move the blocking member 18 from its closed position, thus gaining access to the live receptacle 56. Since the end of section 62 of the blocking member 18 is received within the recess 66, one cannot move the blocking member 18 by pushing a screwdriver or similar device past the edge of the blocking member. In addition, the presence of the projection 68 prevents a user moving the blocking member 18 by pushing an object into the live aperture 38 at an inclined angle and pushing on the "step" where the section 62 of the blocking member is joined to the remainder of this member.

When the plug 12 is inserted into the outlet 10 in the direction of arrow A in FIG. 5A, the interaction between the tip of the neutral prong 30 of the plug and the cam surface 60 on the blocking member 18 causes the blocking member 18 to move against the bias of the spring 46 in the direction of arrow B in FIG. 5A. As the plug 12 moves in the direction of arrow A, the tip of the live prong 32 enters into, and is accommodated within, the recess 64 adjacent section 62 of the blocking member 18. Thus, the presence of this recess 64 allows the outlet of the present invention to be used with a plug 12 having neutral and live prongs 30 and 32 of equal length without contact between the live prong 32 and the blocking member interfering with the normal insertion of the plug into the outlet. Eventually, the blocking member 18 moves to the open position shown in FIG. 5B, allowing the neutral prong 30 to pass through the apertures 36, 58 and 50 into the neutral receptacle 54, while the live prong 32 passes through the aperture, past the end of the blocking member 18 and through the aperture 52 into the live receptacle 56. (Although not shown in FIG. 5, the ground prong 34 is of course simultaneous passing through the apertures 40 and 48 (FIG. 2) into the ground receptacle). As the plug 12 is withdrawn from the outlet 10, the movements of the various parts are reversed, and the spring 46 restores the blocking member 18 to its closed position shown in FIG. 5A.

From the foregoing, it will be seen that the outlet 10 provides a high degree of protection against anyone accidentally contacting the live receptacle 56 and receiving an electric shock, but that the outlet 10 in no way hinders the insertion and removal of plugs. Furthermore, the outlet 10 requires no modification of conventional outlet boxes or wiring and thus can readily be substituted for a conventional unprotected outlet. Since the external form of the outlet 10 is identical to that of a conventional outlet, any face plate used with a conventional unprotected outlet can also be used with the outlet 10. Finally, the outlet 10 operates with a conventional plug; this is important, since many plugs now come molded on to the cords of electrical appliances and are not easily replaced by a user, so that any form of protected electrical outlet which requires anything other than a conventional plug is unacceptable to many users.

Figure 3:
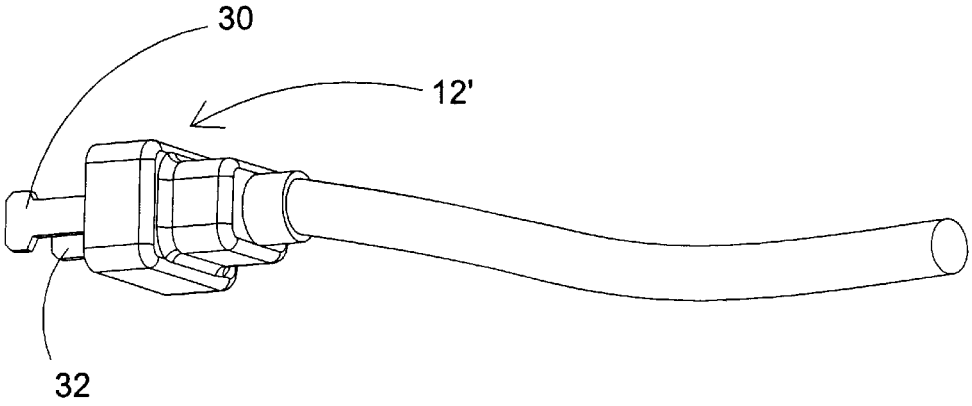
FIG. 3 is a diagrammatic perspective view of a polarized two-pin plug which can be used in the outlet shown in FIGS. 1 and 2.

Since the movement of the blocking member 18 is controlled solely by the interaction between the neutral prong 30 and the cam surface 60 and the blocking member 18 does not interact with the ground prong 34, the outlet 10 can equally well be employed with a conventional two-pin plug, such as the polarized plug 12 shown in FIG. 3, which has a neutral prong 30 and a live prong 32 essentially identical to those of the plug 12, but no ground prong.

Figure 6:
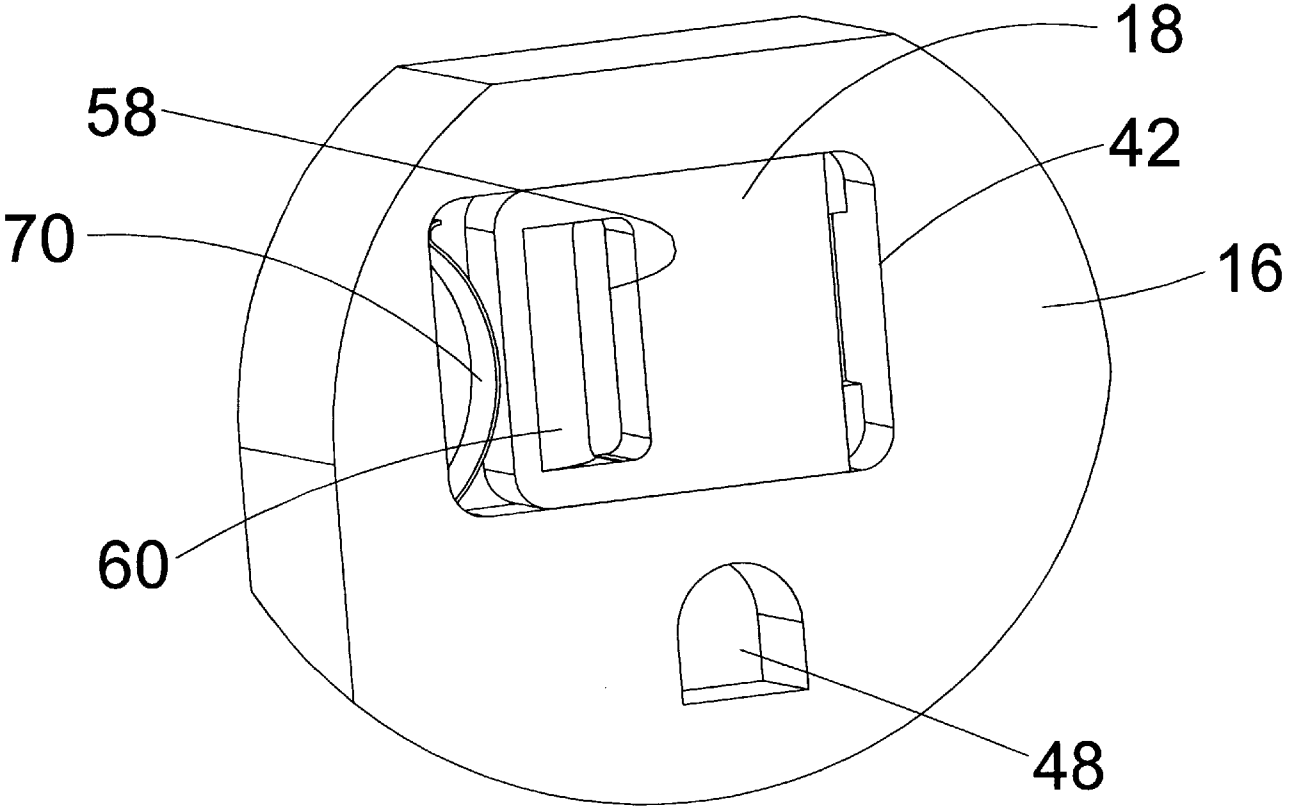
FIG. 6 is an enlarged diagrammatic three-quarter perspective view, similar to that of FIG. 4, of an alternate biasing means which may be substituted for that shown in FIG. 4.

FIG. 6 shows a modified outlet of the invention in which the helical spring 46 shown in FIGS. 2, 3 and 5 is replaced by a leaf spring 70. The form of the blocking member 18 is unchanged. The use of a leaf spring may facilitate assembly of the outlet 10.

Figure 7B:
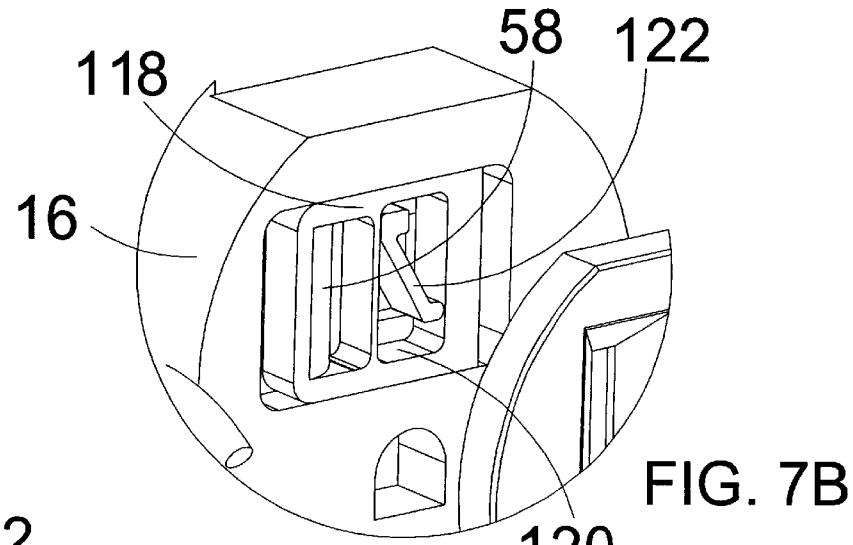
FIG. 7B is a diagrammatic enlarged perspective view of part of FIG. 7A showing the blocking member and biasing means in more detail.
Figure 7C:
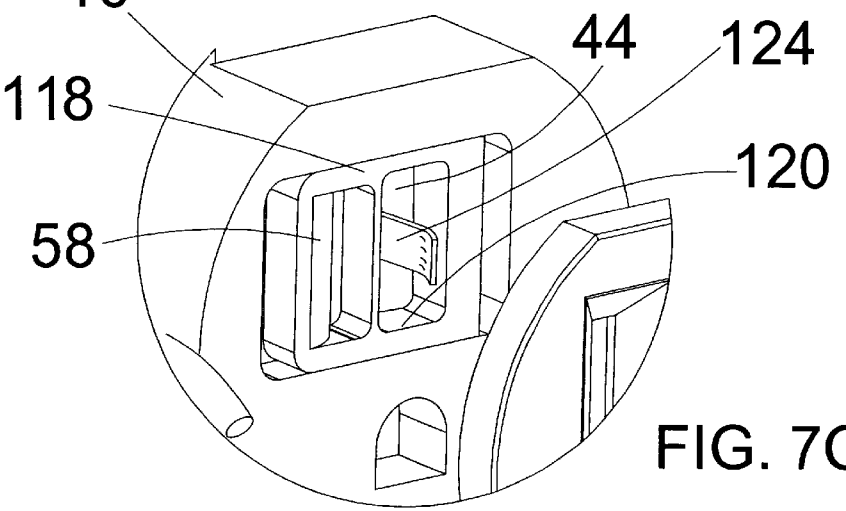
FIG. 7C is a diagrammatic view, similar to that of FIG. 7B, of another form of biasing means which may be substituted for that shown in FIG. 7B.
Figure 7A:
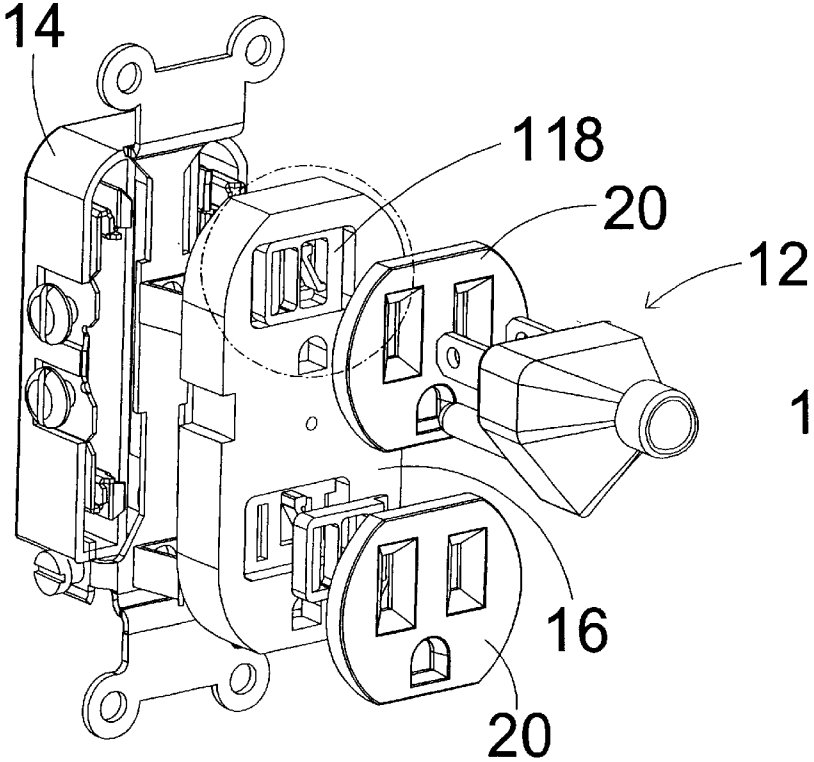
FIG. 7A is a diagrammatic exploded perspective view, similar to that of FIG. 2, of a second outlet of the invention having a biasing means different from those shown in FIGS. 4 and 6.

FIGS. 7A and 7B show a further modification of the outlet using another type of biasing member, which, unlike that shown in FIG. 6, requires a modification of the blocking member. In this embodiment, blocking member 118 is provided with a central aperture 120 lying adjacent the neutral aperture 58, and a biasing member 122 has the form of a flexible member, one end of which is secured to the support surface 44 of the support member 16, the opposed end of the biasing member 122 projecting into the central aperture 120 and contacting with one wall thereof. As the blocking member 118 is moved from its closed to its open position by insertion of a plug, the free end of the biasing member 122 rotates around its fixed end attached to surface 44.

Finally, FIG. 7C shows a further modification of the outlet shown in FIGS. 7A and 7B. The outlet shown in FIG. 7C uses the same modified blocking member 118 but it has a biasing member 124 in the form of a leaf spring, which can be formed as part of one of the receptacles, preferably the neutral receptacle.

In the outlet of the present invention, it is desirable that, when the blocking member is in its closed position, the biasing means maintain a resilient bias on the blocking member. For example, the outlet shown in FIGS. 1, 2, 4 and 5, which uses the helical spring 46 as its biasing means, and in which the blocking member would typically travel 1/16 inch (1.6 mm) between its open and closed positions, preferably has the spring 46 preloaded so that when the blocking member is in its closed position, the spring is compressed about 1/16 inch (1.6 mm).

It is also desirable that the blocking member and biasing means of the outlet of the invention be designed so that, when a plug is withdrawn from the outlet and the blocking member returns to its closed position, an audible "snap" or similar noise is generated, so that a user can be assured that the outlet is functioning correctly.

The face plate, support member and blocking member of the present outlet are preferably formed from a hard wearing, non-conducting material which retains these characteristics over a wide temperature range (say −40° to 225° F., −40° to 108° C.) such as might be encountered under extreme weather conditions in parts of buildings that are not environmentally controlled. Suitable materials include certain polyamides (nylons) and the acetal polymer sold by E. I du Pont de Nemours and Company under the Registered Trademark "Delrin". Other suitable materials will readily be apparent to those skilled in polymer technology.

It will readily be apparent to those skilled in the art that numerous changes and modifications can be made to the preferred safety outlet described above without departing from the scope of the invention. For example, it will be apparent that the safety features of the present invention may be incorporated into extension cords, power strips, working lamps provided with sockets for supplying power to tools, and the like. It should also be equally clear that the blocking member may reside in the face plate or other equivalent support structure. If the outlet is oriented appropriately, so that the blocking member is moved upwardly in passing from its closed to its open position, it may be possible to use gravity as the biasing means for the blocking member, i.e., the blocking member could simply fall back to its closed position under its own weight. It is, therefore, intended that the embodiments described herein be considered as illustrative and not be construed in a limiting sense.

What is claimed is:

1. An electrical outlet adapted to receive an electrical plug having at least live and neutral prongs of equal length, the outlet comprising:

a support member having an outer surface, an inner surface and at least live and neutral apertures extending from the outer surface to the inner surface of said support member;

a live receptacle adapted to receive the live prong and spaced from the inner surface of said support member adjacent the live aperture therein;

a neutral receptacle adapted to receive the neutral prong and spaced from the inner surface of said support member adjacent the neutral aperture therein, said support member and the live and neutral receptacles being arranged so that the live and neutral prongs of the electrical plug can be inserted through the live and neutral apertures, respectively, in said support member and enter the live and neutral receptacles, respectively; and a single blocking member disposed between the inner surface of said support member and the receptacles, and movable between a closed position, in which it blocks the live and neutral apertures in said support member, and an open position, it which it does not block the live and neutral apertures, thereby permitting the live and neutral prongs of the electrical plug to pass through the live and neutral apertures, respectively, in said support member and enter the live and neutral receptacles, respectively, said single blocking member having:

biasing means for biasing the blocking member towards its closed position;

a cam surface disposed adjacent the neutral aperture and arranged to be directly engaged by the neutral prong passing through the neutral aperture, so that contact between the neutral prong and the cam surface will cause the blocking member to move to its open position; and a recess arranged so that, when the blocking member is in its closed position, the recess will lie adjacent the live aperture, such that a portion of the live prong can be accommodated within the recess while the blocking member is still in its closed position, said recess extending to a free edge of said blocking member so that, when said blocking member is in its open position, the live prong of the plug passes beyond the free edge of said blocking member, said support member being further configured with a recess arranged to receive said free edge of said blocking member when said blocking member is in its closed position.

2. An electrical outlet according to claim 1 wherein said blocking member has a neutral aperture through which the neutral prong can pass when said blocking member is in its open position, and wherein said cam surface has the form of an inclined surface, defining part of the periphery of the neutral aperture in said blocking member.

3. An electrical outlet according to claim 1 arranged to receive a plurality of electrical plugs, said support member having at least two sets of live and neutral apertures and said outlet having at least two sets of live and neutral receptacles, said outlet also having at least two blocking members movable independently of each other.

4. An electrical outlet according to claim 1 for use with an electrical plug having a ground prong in addition to its live and neutral prongs, wherein said support member has a ground aperture extending from the outer surface to the inner surface of said support member, and arranged to receive the ground prong of the electrical plug, the ground aperture being spaced from the live and neutral apertures, the electrical outlet further comprising a ground receptacle adapted to receive the ground prong and disposed adjacent the inner surface of said support member adjacent the ground aperture therein.

5. An electrical outlet according to claims 4 wherein, when the blocking member is in its closed position, it does not block the ground aperture.

6. An electrical outlet according to claim 1 wherein the biasing means comprises a flexible member having one end secured to a location fixed relative to said support member and an opposed end arranged to coact with the blocking member.

7. An electrical outlet according to claim 6 wherein said blocking member has a biasing means aperture extending therethrough and said opposed end of the flexible member is arranged to coact with a wall of the biasing means aperture.

8. An electrical outlet according to claim 1 further comprising a face plate having a support surface spaced from the inner surface of said support member so as to form a chamber therebetween, and wherein the blocking member is disposed within this chamber.

9. An electrical outlet according to claim 8 wherein the biasing means comprises a spring acting between said support member and said blocking member.

10. An electrical outlet according to claim 8 wherein the inner surface of said face plate carries a projection extending away from the inner surface adjacent the live aperture and extending into the recess in said blocking member, the projection serving to hinder access to a wall of the recess by an object inserted through the live aperture in said face plate.

11. An electrical outlet adapted to receive an electrical plug having at least live and neutral prongs of equal length, the outlet comprising:

a support member having at least live and neutral apertures extending therethrough;

a live receptacle adapted to receive the live prong inserted through the live aperture;

a neutral receptacle adapted to receive the neutral prong inserted through the neutral aperture; and a single blocking member movable between a closed position, in which it blocks the live and neutral apertures in said support member, and an open position, in which it does not block the live and neutral apertures, said single blocking member having:

biasing means for biasing the blocking member towards its closed position;

a cam surface arranged to be directly engaged by the neutral prong passing through the neutral aperture, so that contact between the neutral prong and the cam surface will cause the blocking member to move to its open position; and a recess arranged so that, when the blocking member is in its closed position, the recess will lie adjacent the live aperture such that a portion of the live prong can be acommodated within the recess, said recess extending to a free edge of said blocking member so that, when said blocking member is in its open position, the live prong of the plug passes beyond said free edge of said blocking member, said support member having a recess arranged to receive said free edge of said blocking member when said blocking member is in its closed position.

12. An electrical outlet according to claim 11 further comprising a projection extending into the recess in said blocking member, the projection serving to hinder access to a wall of the recess.

13. An electrical outlet according to claim 11 wherein said support member has walls defining a chamber, and said blocking member is disposed within said chamber.

14. An electrical outlet according to claim 13 wherein the biasing means comprises a spring acting between said support member and said blocking member.

* * * * *